US010751258B2

(12) United States Patent
Adamucci et al.

(10) Patent No.: US 10,751,258 B2
(45) Date of Patent: Aug. 25, 2020

(54) PHARMACEUTICAL DOSAGE DEVICE, PHARMACEUTICAL DISPENSING UNITS AND SYSTEMS FOR PHARMACEUTICAL DOSAGE ALLOCATION

(71) Applicant: Carmen Adamucci, Bridgeton, NJ (US)

(72) Inventors: Christy Adamucci, Newfield, NJ (US); Carmen Adamucci, Bridgeton, NJ (US)

( * ) Notice: Subject to any disclaimer, the term of this patent is extended or adjusted under 35 U.S.C. 154(b) by 0 days.

(21) Appl. No.: 14/843,651

(22) Filed: Sep. 2, 2015

(65) Prior Publication Data

US 2016/0175200 A1 Jun. 23, 2016

Related U.S. Application Data

(63) Continuation of application No. 13/101,311, filed on May 5, 2011, now abandoned, which is a continuation of application No. PCT/US2009/068543, filed on Dec. 17, 2009.

(60) Provisional application No. 61/138,349, filed on Dec. 17, 2008.

(51) Int. Cl.

| | |
|---|---|
| ***B65D 83/04*** | (2006.01) |
| ***B65B 61/02*** | (2006.01) |
| ***A61J 7/04*** | (2006.01) |
| ***A61J 1/03*** | (2006.01) |
| ***A61J 7/00*** | (2006.01) |

(52) U.S. Cl.

CPC . *A61J 7/04* (2013.01); *A61J 1/03* (2013.01); *A61J 7/0076* (2013.01)

(58) Field of Classification Search

CPC ... A61J 7/04; A61J 7/0076; A61J 1/03; B65D 83/04; B65D 75/327; B65D 83/0445; B65B 5/105; B65B 55/20; B65B 61/025

USPC ..... 206/459.1, 528, 530, 534, 534.1, 206/538–540; 220/23.2, 23.4, 244, 252, 220/291, 315, 825, 832, 836, 200, 212, 220/603, 810, 816, 821, 824; 53/411, 53/443, 474

See application file for complete search history.

(56) References Cited

U.S. PATENT DOCUMENTS 1,333,051 A * 3/1920 Young ..... B65F 1/10 220/252
2,326,886 A * 8/1943 Rathbun ..... A47F 7/03 220/810
2,655,259 A * 10/1953 Davoren ..... A61J 7/0007 206/38
2,657,822 A * 11/1953 Simpson ..... B65D 43/163 220/825

(Continued)

*Primary Examiner* — Luan K Bui
(74) *Attorney, Agent, or Firm* — Calderone Bullock LLC

(57) ABSTRACT

The invention includes a pharmaceutical dispensing cell ("PDC") that includes at least one sidewall having a top edge and a bottom edge; a base plate; and a lid having a first surface and a second surface. The bottom edge of the at least one sidewall is affixed to the base 5 plate, and the lid is rotatably affixed to the at least one sidewall. Also included are methods of regulating the allocation of at least one pharmaceutical unit dosage over time. The method includes inserting a single dosage unit of at least one pharmaceutical dosage in each cell of the dispensing unit of the pharmaceutical dispensing system of the invention. In an embodiment, the system includes a plurality of PDCs having cells that are configured in grid which has an X-axis and a Y-axis.

12 Claims, 6 Drawing Sheets

(56) References Cited

U.S. PATENT DOCUMENTS

| | | | | | |
|---|---|---|---|---|---|
| 2,994,453 | A * | 8/1961 | Gardiner | B65F 1/1607 | 217/57 |
| 3,651,978 | A * | 3/1972 | White | B65D 43/14 | 220/825 |
| 4,649,813 | A * | 3/1987 | Kehl | B65F 1/1405 | 100/227 |
| 4,749,085 | A * | 6/1988 | Denney | B65D 25/103 | 206/459.5 |
| 4,793,492 | A * | 12/1988 | Halbich | A45C 11/24 | 206/538 |
| 4,889,254 | A * | 12/1989 | Vola | A45C 7/0045 | 132/294 |
| 5,158,199 | A * | 10/1992 | Pontius | B65F 1/14 | 119/168 |
| 5,407,089 | A * | 4/1995 | Bird | A47L 13/52 | 15/257.1 |
| 5,611,450 | A * | 3/1997 | DeMars | B65F 1/14 | 15/257.3 |
| 5,788,196 | A * | 8/1998 | Forman | A47J 27/10 | 220/252 |
| 6,460,453 | B1 * | 10/2002 | Frauenfeld | A47J 36/06 | 126/33 |
| 6,593,551 | B2 * | 7/2003 | Haber | A47J 36/06 | 219/214 |
| 2005/0218031 | A1 * | 10/2005 | Murphy | B65D 21/0204 | 206/538 |
| 2006/0070944 | A1 * | 4/2006 | Ahn | A47J 27/10 | 210/470 |
| 2007/0034635 | A1 * | 2/2007 | Chiou | B65F 1/1623 | 220/810 |

* cited by examiner

PHARMACEUTICAL DOSAGE DEVICE, PHARMACEUTICAL DISPENSING UNITS AND SYSTEMS FOR PHARMACEUTICAL DOSAGE ALLOCATION

CROSS REFERENCE TO RELATED APPLICATION

This application is a continuation of prior filed U.S. Ser. No. 13/101,311, filed May 5, 2011, now abandoned, which claims priority under 35 U.S.C. 119 (a-e) to Application Serial No. PCT/US2009/068543, filed Dec. 17, 2009, now abandoned, which in turn claims priority to U.S. Provisional Patent Application No. 61/138,349, filed Dec. 17, 2008, the entire disclosures of each of which are incorporated herein by reference.

BACKGROUND OF THE INVENTION

As the population ages and medical science advances, a large portion of the population finds itself on regimens of one or more pharmaceuticals, often involving a dosage schedule of medication administration one, two, three, or four times a day spaced out over the 24-hour period. Often individuals' ability to comply with their dosage regimen is compromised by the difficulty associated with remembering when/if one has taken one's pills at each time point during the day, from day to day, during the course of a week. Consequently, patients may miss dosages or inadvertently overdose. Unintentional noncompliance through simple confusion of when and if one has taken one's medications, may result in serious medical complications and consequences for the individual, including reduction in the patient's quality of life and serious health dangers.

Thus, remains a need in the art for a pharmaceutical dosage allocation system that permits the individual patient an easy, visual, substantially foolproof way of maintaining compliance with his or her pharmaceutical regimen.

BRIEF SUMMARY OF THE INVENTION

The invention includes a pharmaceutical dispensing cell ("PDC") that includes at least one sidewall having a top edge and a bottom edge; a base plate; and a lid having a first surface and a second surface. The bottom edge of the at least one sidewall is affixed to the base plate, and the lid is rotatably affixed to the at least one sidewall.

The invention further includes pharmaceutical dispensing systems that incorporate one, two, and/or three or more PDCs.

Also included are methods of regulating the allocation of at least one pharmaceutical unit dosage over time. The method includes inserting a single dosage unit of at least one pharmaceutical dosage in each cell of the dispensing unit of the pharmaceutical dispensing system of the invention. In an embodiment, the system includes a plurality of PDCs having cells that are configured in grid which has an X-axis and a Y-axis. Each cell on the X-axis may correspond to a day of the week and each cell on the Y-axis may correspond to a pre-determined time point.

BRIEF DESCRIPTION OF THE SEVERAL VIEW OF THE DRAWINGS

Figure 5:
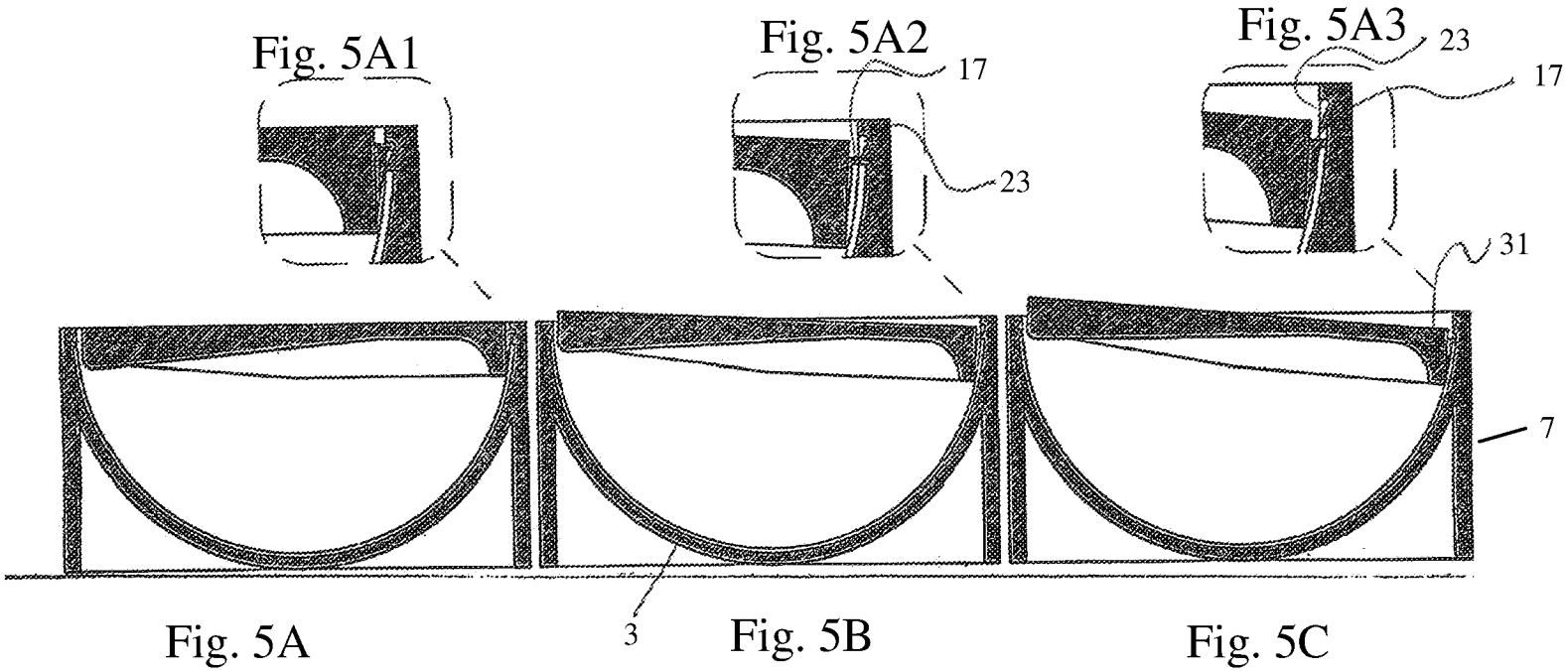

FIG. 5 including FIGS. 5A, 5A1, 5A2, 5A3, 5B, 5B1, and 5C shows cross sectional views of an embodiment of a pharmaceutical dispensing cell of the invention having an interlocking tab mechanism.

Figure 6:
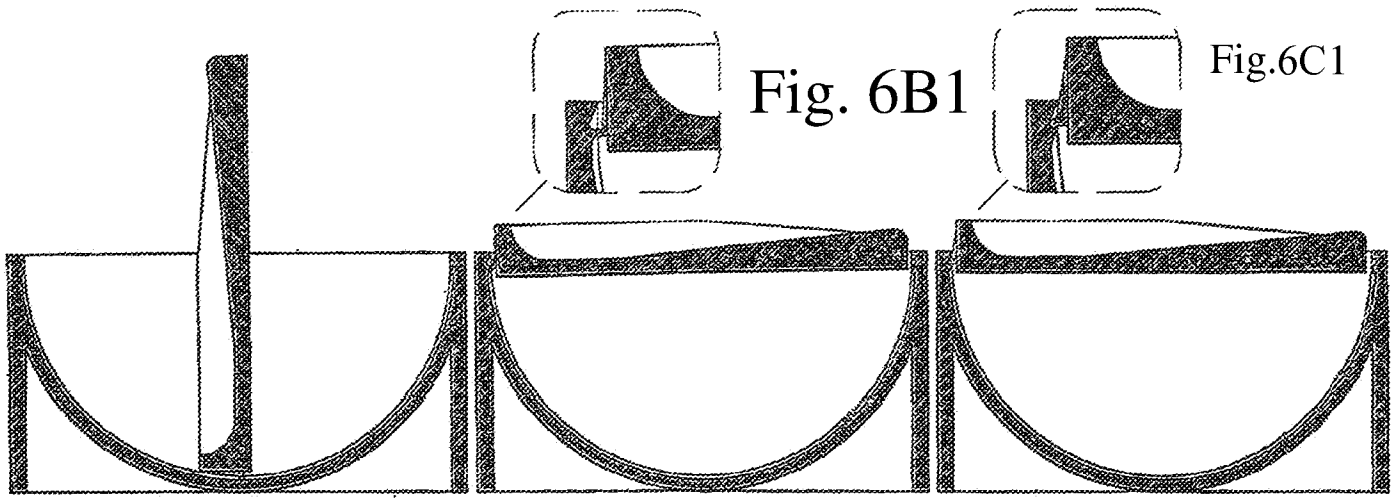
Figure 7:
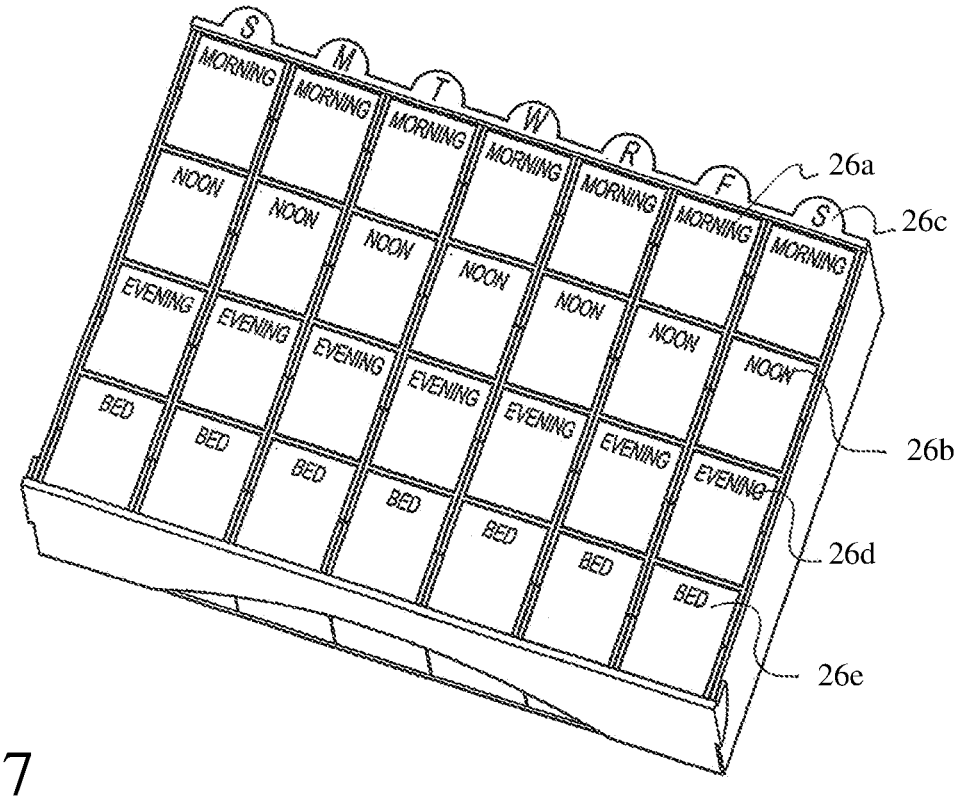

FIG. 6, including FIGS. 6A, 6B, 6B1, 6B2, and 6C, shows cross sectional views of an embodiment of a pharmaceutical dispensing cell of the invention having an interlocking tab mechanism; and FIG. 7 is a plan view of an exemplary pharmaceutical dispensing unit;

DETAILED DESCRIPTION OF THE INVENTION

The invention includes a pharmaceutical dispensing cell, a pharmaceutical dispensing unit that includes one or more of the cells, and systems and methods of pharmaceutical allocation that include use of the pharmaceutical dispensing cell and/or dispensing unit.

By the term "pharmaceutical dosage unit" it is meant any single dosage unit or delivery system containing any medication (prescription or non-prescription), vitamin, mineral, nutritional supplement, fiber or other non-nutritive deliverable, or other material that is administered to a mammalian patient repeatedly over any time period, e.g., once a week, once a year, once a day, once a month, twice a day, twice a week, twice a month, etc. Such pharmaceutical dosage forms may be in any delivery system, or dosage format, for example, pills, capsules, powders, liquids, injectable forms, patch or strip delivery forms, suppositories and may include pharmaceuticals formulate for any route of administration.

In some instances, for example, when the medication is to be administered is provided to the patient in a form that cannot be pre-allocated into single dosage units (e.g., cough syrup or by inhaler) the term "pharmaceutical dosage unit" may include a representative token or chit that is placed in the appropriate pharmaceutical dispensing cell and/or system and, in practice of the system (described below), is removed from the cell and discarded upon administration of a dosage medication to the patient.

Figure 1:
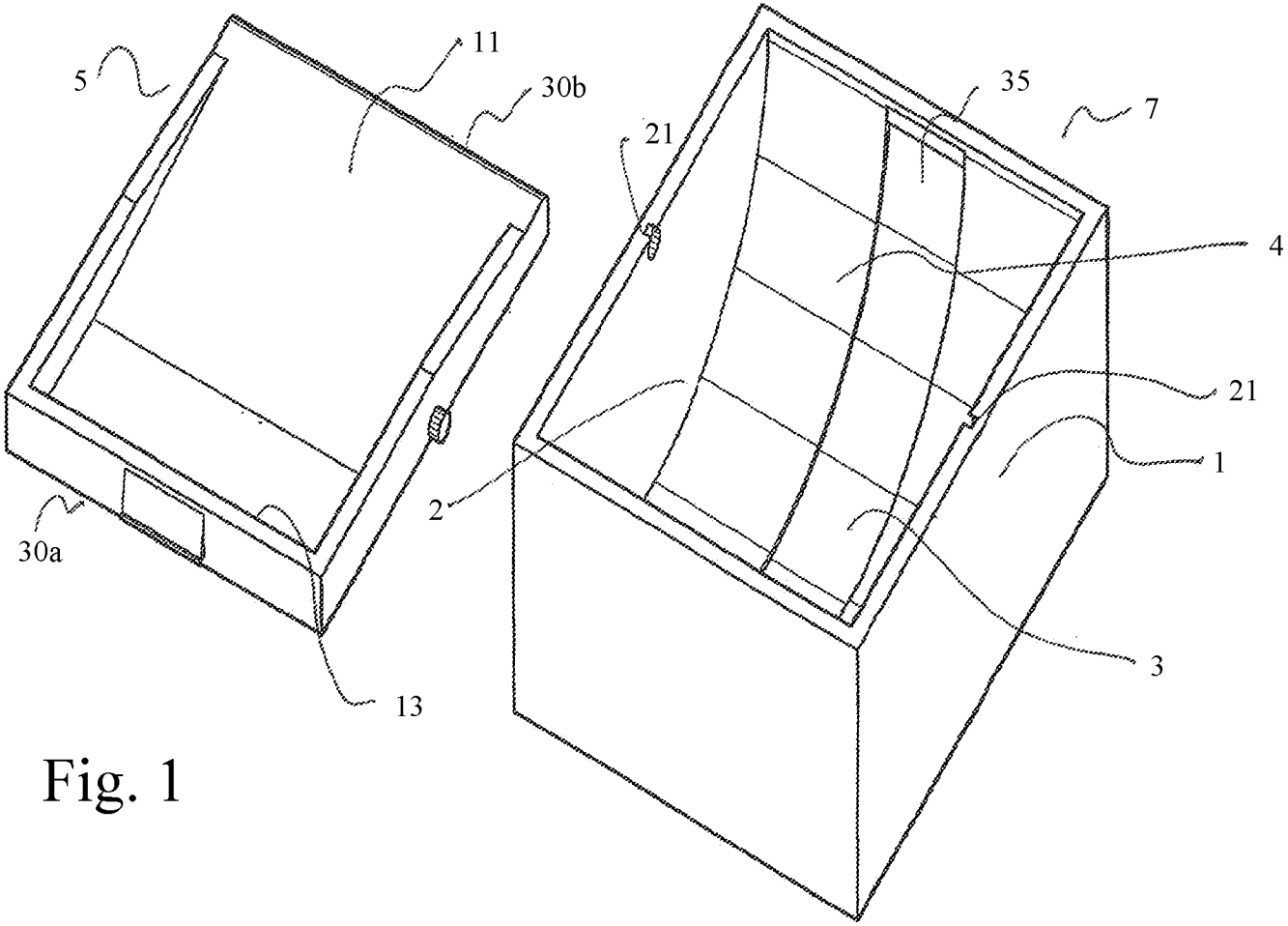
FIG. 1 is a perspective view of an exemplary polygonal pharmaceutical dispensing cell with the lid removed and overturned.

The pharmaceutical dispensing unit is composed of one or two or more pharmaceutical dispensing cells ("PDCs"). FIG. 1 shows an individual dispensing PDC (lid detached) including a cell body (7) and a lid (5). Each cell body (7) includes at least a base plate (3) and at least one sidewall (1). The sidewalls (1) are affixed to the base plate (3) to form an interior chamber (2) having an opening (4) into which the pharmaceutical dosage form(s) are placed. The sidewalls (1) and/or base plate (3) may be substantially planar or they may be curved (as seen in FIG. 1) or bear convolutions, bumps, projections, etc. In an embodiment, it may be desirable that the sidewalls and/or base plate are composed of a continuous solid structure (e.g., not containing perforations). In other embodiments, one may prefer that the materials used contain perforations, vents, pinholes, and the like for example, to allow for all flow and avoid moisture accumulation in the chamber. In some embodiments, the chamber (2) may contain an insert placed over the base plate (3) or base plate (3) may be a surface coated with fabric and/or preservative or antibacterial material.

In an embodiment, one may prefer that the material used to form the sidewall(s) and/or base plate is a mesh or other discontinuous material, such as a wire or plastic mesh.

The PDC includes a lid (5), that covers at least a portion of the chamber's opening (4). The lid is rotatably affixed to the at least one sidewall (1), such that it can be rotated at least 90° around the hypothetical axis created by the attachment point(s) (21). Preferably, the lid (5) is attached so that it can be rotated at least 100°, at least 130° or at least 180° around the hypothetical axis.

The PDC and any component parts (inserts, etc.) may be fabricated of any material known or developed in the art. Examples may include metals, aluminum, meshes (e.g., plastic or wire), polymer composites, laminates, plastics, thermoplastics, elastomeric materials, wood, wood composites, paper, cardboard, mylar, cellulosic materials, and any other formable or moldable materials.

The PDC may be of any three dimensional cell shape, for example, cylindrical, polygonal prism, truncated cone, truncated pyramid, etc. In an embodiment, it may be preferred that the shape is that of a polygonal prism, especially, for example, a square prism or a rectangular prism.

The at least one sidewall of the PDC includes a top edge and a bottom edge. The number of sidewalls present may be informed by the three dimensional shape of the PDC. For example, if the PDC is in the form of cylinder, it will include one sidewall. A rectangle prism shaped PDC may include four sidewalls.

Regardless of number, the bottom edge of the sidewall is attached to the base plate by any means known or to be developed in the art, including nails, pins, adhesives, soldering seams and the like. Alternatively, the base plate and sidewall(s) may be unitarily formed by a molding, pressing or other forming processes.

Figure 4:
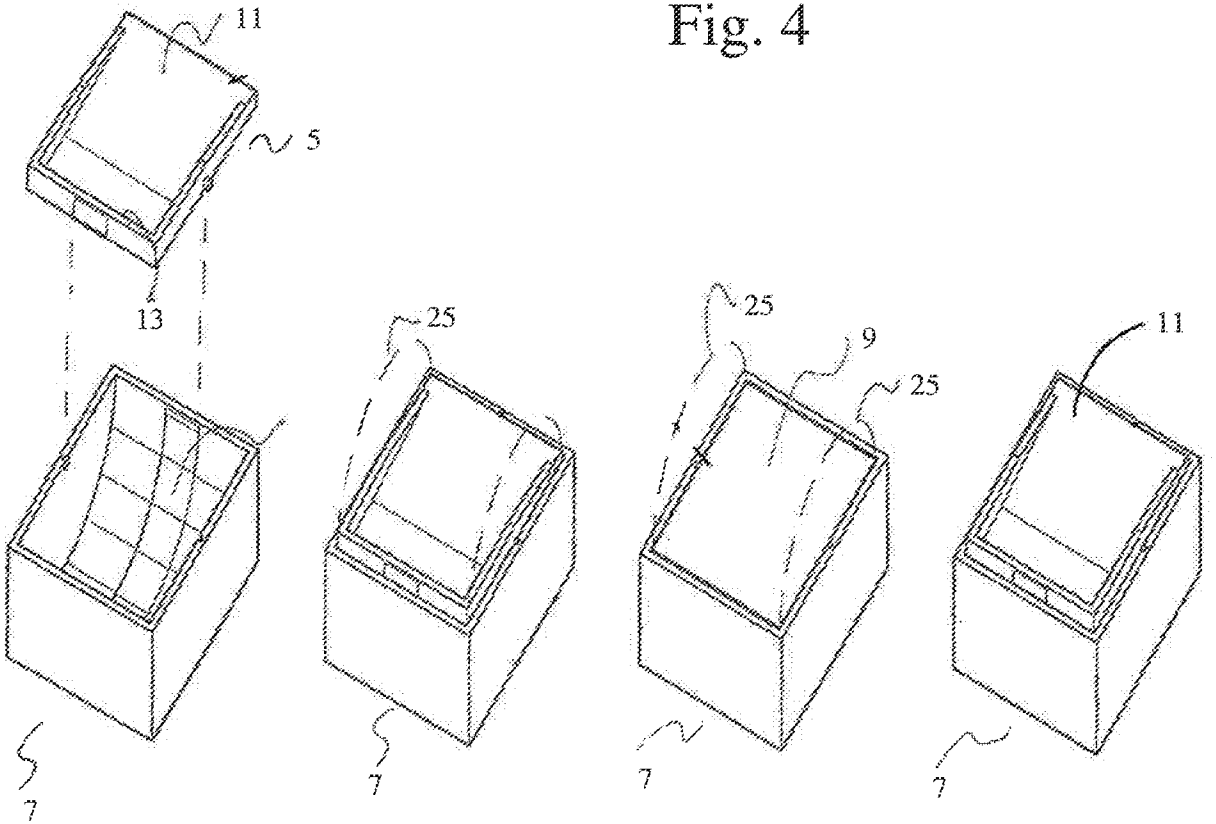
FIG. 4 illustrates several perspective views of a polygonal pharmaceutical dispensing cell, wherein the lid is removed.

As shown in FIG. 4, the lid (5) has a first surface and a second surface and is rotatably affixed to the at least one sidewall at least one point along a hypothetical axis X-X of the lid. The first surface (9) and the second surface (11) may independently bear visually or tacitly tactilely distinct markings (26*a-e*) so that a user of the pharmaceutical dispensing system can visually or tactilely determine whether the lid of any given PDC has been rotated or not (thereby providing indication of whether the contents of the particular PDC have been consumed). For example, the first surface may be green colored and the second surface may be red; the surface may bear text (e.g., "Monday a.m" and the second side may bear different text (e.g., "Completed"). Alternatively, the first surface may bear markings designating the time of day at which the contents of the cell should be consumed, as in, for example, FIG. 7.

In an embodiment, the second surface of the lid includes a scooping structure (13) to facilitate the removal of the pharmaceutical dosage from the PDC chamber upon rotation of the lid (FIGS. 1, 2, 3, 4, 5, and 6). The scooping structure (13) may be any shape or configuration, such as, in cross section, square, rectangular, other polygonal shape, curved, rounded, inwardly curved, outwardly curved, triangular, or undulating. The scooping structure may be located at any area along the second surface, although in an embodiment it is preferred that the scooping structure is located substantially outwardly from the location of the hypothetical X-X axis around which the lid (5) rotates.

The scooping structure (13) may take any form or combination of elements that facilitates removal of the pharmaceutical dosage. The scooping portions (13) of the lid (5) may take the form of a unitary bar or a series of bars, projections, villi, bumps, etc. arranged in uniform or non uniform patterns. Alternatively, in several differing embodiments the scooping structure (13) is in the form of a curvature applied to the outermost edges of the lid or a brush-like or flexible structure on outermost edges (30*a*, 30*b*) applied to the second surface of the lid. In an alternative embodiment, the scooping structure (13) may take the form of a walled structure on the second surface of the lid. For example, referencing, e.g., FIG. 1, the lid (5) may include a wall-like structure placed along each of the lids lid's edges perpendicular to the plane of the second surface (11).

The lid (5) is rotatably affixed to the at least one sidewall. The lid may be affixed at one, two, three, four or more points. By rotatably affixed, it is meant that the lid is attached to the at least one sidewall but capable of swiveling around such hypothetical X-X originating from at least one point of affixation. In an embodiment, it is preferred that the lid is of a dimension that if barely clears the base plate or insert overlaying the base plate. Alternatively, if the lid or the lid outermost edges are made of a flexible or brush-type material, the lid dimensions may be slightly greater grater so that the edges brush or sweep the base plate upon rotation.

Any mechanism may be used to rotatably affix the lid to the sidewall(s). For example, the lid may include tabs, pins or other protrusions on two of its edges, which fit into slots, vents, or notches, located in the sidewall(s) or vice versa. In another embodiment, the lid includes an axle having a first end and a second end and which is located on the first surface, the second surface, or running transversely through the lid. The first and second end of the axle can be fitted into holes, notches, etc, in the sidewall.

Figure 2A:
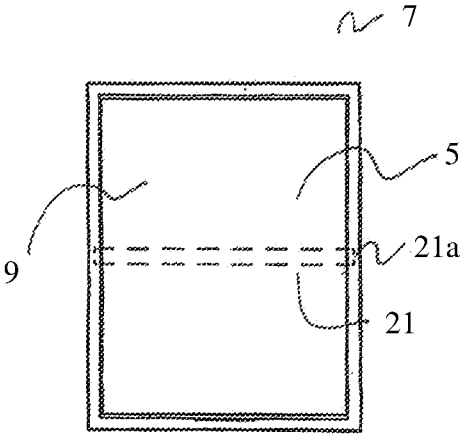
FIG. 2A is a top plan view of exemplary polygonal pharmaceutical dispensing cell with the lid closed.
Figure 2B:
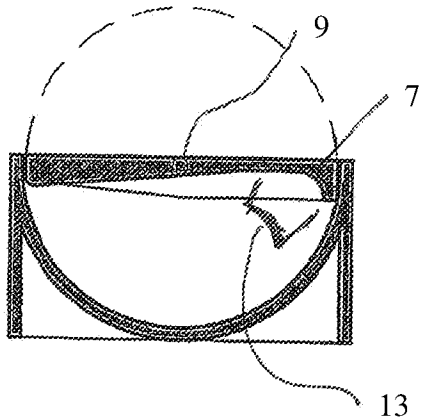
FIG. 2B is a cross sectional view of the polygonal pharmaceutical dispensing cell of FIG. 2A.
Figure 3A:
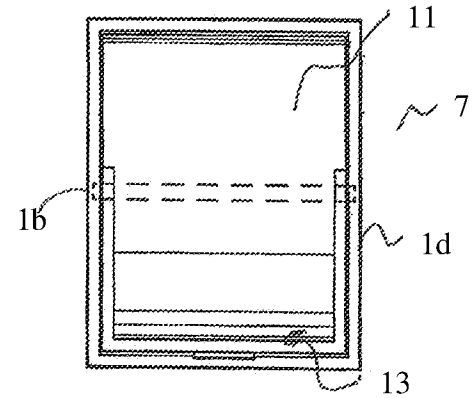
FIG. 3A is a top plan view of exemplary polygonal pharmaceutical dispensing cell with the lid open/overturned.
Figure 3B:
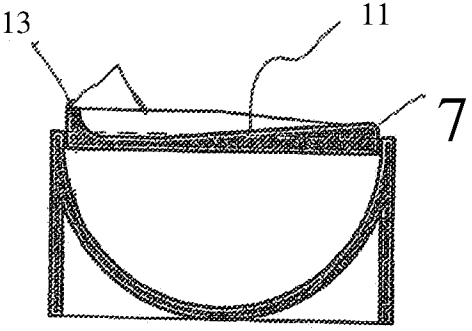
FIG. 3B is a cross sectional view of the polygonal pharmaceutical dispensing cell of FIG. 3A.

FIGS. 2,3, an exemplary pharmaceutical dispensing cell is shown in cross section. The cell is in a polygonal configuration and includes four sidewalls (one of which cannot be seen because of cross sectioning). The cell (19) includes a lid (5) which is affixed to each of the sidewalls 1 B and 1D (not shown) of the cell by an axle (21), itself having a circular cross section. The axle (21) is attached to the second surface of the lid and its first end (21*a*) and its second end (not shown) are inserted into notches in the sidewalls 1*b* and 1*d*.

The lid (5) includes a scooping structure in the form of a curved edge on the outermost portions of the lid (5) and the second surface bears a three walled structure scooping structure (13). When the lid (5) is rotated around the hypothetical axis X-X, the scooping structure of the lid follows a hypothetical circular pathway (25) within the interior of the chamber, scooping the pharmaceutical dosages that have been placed within the cell and bringing them to the surface of the box when the lid is rotated to about 180°.

In an embodiment of the invention the base plate is curved (or is overlayed with an insert that is curved) inwardly towards the space within the chamber substantially along the curve defined by circular pathway (25) made by the scooping structure of the lid (5) when it is rotated the facilitates efficient capture of the pharmaceutical dosage forms by the scooping structure upon rotation of the lid.

In an embodiment, the PDC includes a locking or securing mechanism that permits the user to secure the lid such that the first surface of the lid visually or tactilely accessible (indicating the pharmaceutical dosage forms within the container have not been consumed) and/or with the second surface of the lid visually or tactiley accessible (indicating that the pharmaceutical dosage forms have been consumed).

Many suitable mechanisms are known in the art, such as interlocking tabs, self renewing adhesives, and the like and any such mechanism may be used in the PDC. Alternatively, it may be preferred that the locking mechanism includes an interlocking toothed gear attached to the side of the axle. A lever affixed to the lid includes teeth which interlock with gear teeth. Upon rotation of the lid, a tab is conveyed along an arctuate hypothetical pathway through the interior of the pharmaceutical cell thereby capturing the pharmaceutical dosage forms located within the cell and bringing them to the plane of the top surface of the cell. Once rotated, the lid is locked in place by the interlocking teeth of the gear and tab.

Another suitable locking mechanism may include a triangular cam that is attached to one side of an axle of a round cross section by the first end about which the lid is capable of rotating. Also attached to the axle by an end that is an elongate arm. The arm may be retractable and/or flexible. As the lid rotates around the axle, the adjustable arm rides over the cam until it is behind the cam and is locked into place by the cam. The arm prevents the lids from rotating backward if, for example, additional pressure is applied during retrieval of the contents of the cell.

FIGS. 5 and 6 show an embodiment of the invention containing a tabbed locking mechanism for the lid. FIG. 5A shows a cross section of a pharmaceutical dispensing cell in which the lid (5) is closed. FIG. 5A1 is a blown up detail of the tabbed mechanism. A tab (17) located on the first end (31) of the lid (5) is inserted into a groove (23) in the sidewall, which prevents the lid (5) from moving in the backward direction. In addition, the sidewall may also contain an outwardly protruding member (27) that prevents lid from moving in the forward direction, in the absence of a force applied to the lid.

FIG. 5B shows the same cell in cross section, wherein the tabbed mechanism is in the process of disengagement. As can be seen in FIG. 5B2, when force is applied to the first surface f the lid, the tab (17) slides out of the groove (23), allowing the lid to be disengaged from locking position. In an embodiment, it may be preferred that wither the tab or material forming the groove is a flexible material, to facilitate disengagement.

FIG. 5C shows the same cell in cross-section, wherein the tabbed mechanism is disengaged. The base plate (3) includes a tab track (35) into which the tab can travel, so as not to scrape or damage the base plate.

FIG. 6A shows the same cell in cross-section, but wherein the lid has been rotated about 90 degrees around the axle. FIG. 6.B (with detail shown in FIG. 6131) shows the same cell in cross section, wherein the tabbed mechanism is in the process of engagement. If the cell had contained a pharmaceutical dosage, the dosage would now be located outside of the chamber and on the second surface of the lid. FIG. 6C, with detail shown in 6C1, shows the tabbed mechanism again in locked position.

Also included in the invention are pharmaceutical dispensing units that comprise a plurality of the cells described above in any configuration. In embodiment, the dispensing unit contains a plurality of cells configured in a grid having an X axis and a Y axis. For example, a dispensing unit containing four cells along the Y axis and seven cells along the X axis forming, in plan view, a grid-like structure, is envisioned. The individual columns of the grid may signify the days of the week, Monday through Sunday. The rows of the grid may signify time points during the day at which a specific pharmaceutical dosage is to be administered.

The dispensing units may comprise as many or as few dispensing cells as desired. The units may be formed integrally so that the cells may share adjoining sidewalls with the adjacent cell. Alternatively, the unit may consist of two or more detachably attached or modular dispensing cells, so that the dispensing units may be configured to meet different drug dosage regimens, reduced in size for travel.

An exemplary embodiment is shown in FIG. 7. Each dispensing cell may be independent, but is adapted to attach to one another and/or adapted to fit into a tray-like cell holder. Alternatively, a set of cells whose number represents the number of dosages desired in a 24-hour period may be formed as a unit in a column configuration. For at-home use; the system would include a cell holder having one or more days-worth of dispensing units included therein. If desired, for travel, one could remove a column of cells, while not disturbing the remaining week's dosages.

Also included with the invention are methods of regulating the allocation of at least one pharmaceutical dosage over time. The method includes use of a pharmaceutical dispensing unit as described above wherein each cell on the X axis corresponds to a day and each cell on the Y axis corresponds to a predetermined time point in a day (Monday morning 10:00, Monday lunch, Monday bedtime, etc.). The at least one pharmaceutical dosage which should be administered at each of the time points as placed within the appropriate dispensing cell chamber. The dosage forms are dispensed by rotating the lid around the axis to expose the second surface and to scoop up and provide access to the pharmaceutical dosage forms. In an embodiment, it may be preferred that the first side of the lid and the second side of the lid are each distinctly decorated so that the user has a visual aid indicating whether or not he or she has taken the appropriate dosage at the appropriate time.

Other uses of the systems, cells, methods described herein are contemplated, including, for example, use of the cell or system as an "Advent Calendar" or use of the cell or system with representative tokens or chits as a memory aid to facilitate the completion of certain activities, tasks, etc.

Example 1

A pharmaceutical dispensing unit is prepared by attaching twenty eight PDC to a baseboard in a 4 row by 7 column grid arrangement. Each of the individual dispensing cells has a lid with a first surface that is colored green and a second surface that is colored red. Additionally, each of the first surfaces is labeled with text as shown in the diagram below:

| | | | | | | |
|---|---|---|---|---|---|---|
| Monday | Tuesday | Wednesday | Thursday | Friday | Saturday | Sunday |
| Morning | Morning | Morning | Morning | Morning | Morning | Morning |
| Monday | Tuesday | Wednesday | Thursday | Friday | Saturday | Sunday |
| Noon | noon | noon | noon | noon | noon | noon |
| Monday | Tuesday | Wednesday | Thursday | Friday | Saturday | Sunday |
| Evening | Evening | Evening | Evening | Evening | Evening | Evening |
| Monday | Tuesday | Wednesday | Thursday | Friday | Saturday | Sunday |
| Bedtime | Bedtime | Bedtime | Bedtime | Bedtime | Bedtime | Bedtime |

Into each PDC chamber is placed one representative token (intended to represent one inhalation dosage of beclomethasone dipropionate). An asthma patient is prescribed a regimen consisting of a beclomethasone dipropionate dosage four times a day administered via the inhalation route. The patient is provided with an appropriately loaded inhaler and the pharmaceutical dispensing unit described above. Beginning Monday, at each dosage interval the patient swivels the lid of the appropriate PDC, removes the representative token, and administers the medication to himself. On Thursday, at 7 pm, the dispensing unit is that portrayed in FIG. 10.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A method of regulating allocation of at least one pharmaceutical dosage over time, the method comprising providing a dispensing unit comprising a plurality of cells configured in a grid having an X-axis and a Y-axis, wherein the X-axis contains seven cells, wherein each cell on the X-axis corresponds to a day of the week and each cell on the Y-axis corresponds to a pre-determined time point, and inserting a single dosage unit of the at least one dosage in each cell of the dispensing unit, wherein the cells of the dispensing unit each comprise:

a. at least one sidewall having a top edge and a bottom edge;

b. a base plate; and c. a lid having a first surface, a second surface; and including at least one outermost portion, wherein the bottom edge of the at least one sidewall is affixed to the base plate, the at least one sidewall and the base plate define an interior space accessible via an opening, and the lid is rotatably affixed to the at least one sidewall at a first attachment point, and the outermost portion of the lid is downwardly rotatable about a hypothetical axis located between the attachment point to pass through the opening into the interior space of the cell, wherein a dimension of the lid extending from the hypothetical axis to the outermost portion is such that when the lid is rotated about the hypothetical axis, the outermost portion barely clears the base plate and wherein at least one of the first surface and the second surface of the lid further comprises a scooping structure.

2. The method according to claim 1, wherein the Y-axis of the dispensing unit contains about two to about twelve cells.

3. The method according to claim 1, wherein the Y-axis of the dispensing unit contains about two to about six cells.

4. The method of claim 1, wherein the first surface of each lid is independently marked to indicate the day of the week to which it corresponds.

5. The method of claim 1, wherein the first surface of each lid is independently marked to indicate the day of the week and the time point to which it corresponds.

6. The method of claim 1, wherein the pharmaceutical dosage is selected from the group consisting of a vitamin, a mineral, a prescription drug, a non-prescription drug, a nutritional supplement and a fiber delivery system.

7. The method of claim 1, comprising inserting a single dosage unit of about two to about ten pharmaceutical dosages in each cell.

8. The method according to claim 1, wherein one or more of the sidewall, the base plate and the lid of a cell independently comprises a material selected from the group consisting of a thermoplastic material, a thermosetting material, wood, paper, cardboard, a metal, a composite, an aluminum, a textile, glass, ceramic, and mixtures thereof.

9. The method according to claim 1, wherein the cells have four sidewalls configured to form a polygon.

10. The method according to claim 1, wherein the cells have four sidewalls configured to form a rectangle.

11. The method according to claim 1, wherein the cells comprise four sidewalls configured in the form of a rectangle affixed to a base plate having a substantially rectangular plan view.

12. The method according to claim 1, wherein each cell is detachably attached to at least one other cell.

* * * * *